US010053993B2

(12) United States Patent
Tham et al.

(10) Patent No.: US 10,053,993 B2
(45) Date of Patent: Aug. 21, 2018

(54) SHROUDED TURBINE AIRFOIL WITH LEAKAGE FLOW CONDITIONER

(71) Applicant: Siemens Energy, Inc., Orlando, FL (US)

(72) Inventors: Kok-Mun Tham, Oviedo, FL (US); Ching-Pang Lee, Cincinnati, OH (US); Li Shing Wong, Oviedo, FL (US); Andrew S. Lohaus, Berlin (DE); Farzad Taremi, Palm Beach Gardens, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 15/552,982

(22) PCT Filed: Mar. 17, 2015

(86) PCT No.: PCT/US2015/020907
§ 371 (c)(1),
(2) Date: Aug. 23, 2017

(87) PCT Pub. No.: WO2016/148694
PCT Pub. Date: Sep. 22, 2016

(65) Prior Publication Data

US 2018/0030838 A1 Feb. 1, 2018

(51) Int. Cl.
*F01D 5/22* (2006.01)

(52) U.S. Cl.
CPC ..... *F01D 5/225* (2013.01); *F05D 2220/32* (2013.01); *F05D 2260/60* (2013.01)

(58) Field of Classification Search
CPC ..... F01D 5/225; F01D 5/143
See application file for complete search history.

(56) References Cited

U.S. PATENT DOCUMENTS 6,155,778 A 12/2000 Lee et al.
6,196,792 B1 3/2001 Lee et al.
(Continued)

FOREIGN PATENT DOCUMENTS

EP 1559871 A2 8/2005
EP 1609951 A1 12/2005

OTHER PUBLICATIONS

PCT International Search Report and Written Opinion dated Oct. 30, 2015 corresponding to PCT Application PCT/US2015/020907 filed Mar. 17, 2015.

*Primary Examiner* — Justin Seabe

(57) ABSTRACT

A shrouded turbine airfoil (10) with a leakage flow conditioner (12) configured to direct leakage flow to be aligned with main hot gas flow is disclosed. The leakage flow conditioner (12) may be positioned on a radially outer surface (18) of an outer shroud base (20) of the outer shroud (22) on a tip (24) of an airfoil (10). The leakage flow conditioner (12) may include a radially outer surface (28) that is positioned further radially inward than the radially outer surface (18) of the outer shroud base (20) creating a radially outward extending wall surface (30) that serves to redirect leakage flow. In at least one embodiment, the radially outward extending wall surface (30) may be aligned with a pressure side (38) of the shrouded turbine airfoil (10) to increase the efficiency of a turbine engine by redirecting leakage flow to be aligned with main hot gas flow to reduce aerodynamic loss upon re-introduction to the main gas flow.

18 Claims, 7 Drawing Sheets

(56) References Cited

U.S. PATENT DOCUMENTS

| | | | | |
|---|---|---|---|---|
| 6,354,795 | B1 | 3/2002 | White et al. | |
| 6,379,528 | B1 | 4/2002 | Lee et al. | |
| 6,491,498 | B1 * | 12/2002 | Seleski | F01D 5/147 415/173.4 |
| 7,387,488 | B2 | 6/2008 | Nichols et al. | |
| 7,396,205 | B2 * | 7/2008 | Dube | F01D 5/143 415/173.5 |
| 7,438,520 | B2 | 10/2008 | Ruthemeyer et al. | |
| 7,448,846 | B2 | 11/2008 | Ruthemeyer et al. | |
| 7,452,183 | B2 | 11/2008 | Ruthemeyer et al. | |
| 7,604,453 | B2 | 10/2009 | Lee et al. | |
| 7,665,953 | B2 | 2/2010 | Lee et al. | |
| 7,690,885 | B2 | 4/2010 | Lee et al. | |
| 7,722,315 | B2 | 5/2010 | Lee et al. | |
| 7,740,442 | B2 | 6/2010 | Lee et al. | |
| 8,047,793 | B2 * | 11/2011 | Baumas | F01D 5/147 416/191 |
| 8,104,292 | B2 | 1/2012 | Lee et al. | |
| 8,147,192 | B2 | 4/2012 | Jones et al. | |
| 8,864,452 | B2 | 10/2014 | Tham et al. | |
| 9,683,446 | B2 * | 6/2017 | Shaffer | F01D 5/225 |
| 2003/0194312 | A1 | 10/2003 | Burnett et al. | |
| 2007/0031240 | A1 | 2/2007 | Nichols et al. | |
| 2007/0031243 | A1 | 2/2007 | Ruthemeyer et al. | |
| 2007/0031244 | A1 | 2/2007 | Ruthemeyer et al. | |
| 2007/0031255 | A1 | 2/2007 | Ruthemeyer et al. | |
| 2008/0127491 | A1 | 6/2008 | Lee et al. | |
| 2008/0131259 | A1 | 6/2008 | Lee et al. | |
| 2008/0131262 | A1 | 6/2008 | Lee et al. | |
| 2008/0131263 | A1 | 6/2008 | Lee et al. | |
| 2008/0206042 | A1 | 8/2008 | Lee et al. | |
| 2009/0155051 | A1 | 6/2009 | Lee et al. | |
| 2010/0034647 | A1 | 2/2010 | Lee et al. | |
| 2010/0074745 | A1 | 3/2010 | Jones et al. | |
| 2012/0051930 | A1 | 3/2012 | Pandey et al. | |
| 2012/0195766 | A1 * | 8/2012 | Cohin | F01D 5/225 416/241 A |
| 2013/0017080 | A1 | 1/2013 | Tham et al. | |
| 2013/0017095 | A1 | 1/2013 | Lee et al. | |

* cited by examiner

SHROUDED TURBINE AIRFOIL WITH LEAKAGE FLOW CONDITIONER

FIELD OF THE INVENTION

This invention is directed generally to turbine airfoils, and more particularly to flow conditioners on outer shrouds on shrouded turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures.

A turbine blade is formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. Some turbine blades include outer shrouds, as shown in FIG. 1, attached to the tips. Tip leakage loss, as shown in FIG. 2, is essentially lost opportunity for work extraction and also contributes towards aerodynamic secondary loss. To reduce overtip leakage, shrouded blades typically include a circumferential knife edge for running tip gaps. One of the major loss mechanisms on shrouded turbine stages is the cavity loss, in particular, the mixing loss due to reentry of tip shroud leakage flow, as shown in FIG. 2, from the cavity into the main gas path. Overtip leakage flow is not turned by the rotor blade, hence leaving the shroud cavity with relatively high swirl velocity and at an angular mismatch with main gas flow. This mismatch in flow angle and velocities result in aerodynamic mixing loss.

SUMMARY OF THE INVENTION

A shrouded turbine airfoil with a leakage flow conditioner configured to direct leakage flow to be aligned with main hot gas flow is disclosed. The leakage flow conditioner may be positioned on a radially outer surface of an outer shroud base of the outer shroud on a tip of an airfoil. The leakage flow conditioner may include a radially outer surface that is positioned further radially inward than the radially outer surface of the outer shroud base creating a radially outward extending wall surface that serves to redirect leakage flow. In at least one embodiment, the radially outward extending wall surface may be aligned with a pressure side of the shrouded turbine airfoil to increase the efficiency of a turbine engine by redirecting leakage flow to be aligned with main hot gas flow to reduce aerodynamic loss upon re-introduction to the main gas flow.

In at least one embodiment, the turbine airfoil may be formed from a generally elongated airfoil having a leading edge, a trailing edge, a pressure side, a suction side on a side opposite to the pressure side, a tip at a first end, a root coupled to the airfoil at a second end generally opposite the first end for supporting the airfoil and for coupling the airfoil to a disc. The turbine airfoil may include one or more outer shrouds coupled to the tip of the generally elongated airfoil. The outer shroud may extend in a direction generally from the pressure side toward the suction side and extends circumferentially in a turbine engine. The outer shroud may be formed at least in part by an outer shroud base coupled to the tip of the generally elongated airfoil and an outer shroud body extending radially outward from the outer shroud base. The outer shroud base may have an upstream section extending upstream of the outer shroud body and a downstream section extending downstream of the outer shroud body.

The turbine airfoil may include a downstream leakage flow conditioner positioned in the downstream section extending downstream of the outer shroud body. A radially outer surface of the downstream leakage flow conditioner may be positioned further radially inward than a radially outer surface of the downstream section of the outer shroud base. An intersection between the radially outer surface of the downstream leakage flow conditioner and the radially outer surface of the downstream section of the outer shroud base may be nonparallel and nonorthogonal with a longitudinal axis of a turbine engine in which the generally elongated airfoil is configured to be positioned. The downstream leakage flow conditioner may extend from the outer shroud body to a downstream edge of the outer shroud base.

The intersection between the radially outer surface of the downstream leakage flow conditioner and the radially outer surface of the downstream section of the outer shroud base may be generally aligned with pressure side of the generally elongated airfoil at an intersection of the generally elongated airfoil and the outer shroud. In at least one embodiment, the intersection between the radially outer surface of the downstream leakage flow conditioner and the radially outer surface of the downstream section of the outer shroud base may be formed from a radially outward extending wall surface. The radially outward extending wall surface may include a filleted surface at an intersection with the radially outer surface of the downstream section of the outer shroud base and may include a filleted surface at an intersection with the radially outer surface of the downstream leakage flow conditioner. The radially outer surface of the downstream leakage flow conditioner may be ramped such that a distal edge is positioned radially further outward than a proximal edge at a radially outward extending wall surface between the downstream leakage flow conditioner and the radially outer surface of the downstream section of the outer shroud base.

The turbine airfoil may be include one or more stiffening rails extending radially outward from the radially outer surface of the downstream leakage flow conditioner. A radially outer distal end of the at least one stiffening rail may be positioned radially inward further than the radially outer surface of the downstream section of the outer shroud base. The radially outer distal end of the stiffening rail may be a linear surface or have another configuration. The stiffening rail may extend from the outer shroud body to a downstream edge of the outer shroud base.

The turbine airfoil may also include an upstream leakage flow conditioner positioned on a radially outer surface of the upstream section extending upstream of the outer shroud body. The upstream leakage flow conditioner may be configured in any or all of the configurations described herein for the downstream leakage flow conditioner. Alternatively, the upstream leakage flow conditioner may have other configurations.

An advantage of the leakage flow conditioner is that the leakage flow conditioner promotes work extraction in the shroud cavity.

Another advantage of the leakage flow conditioner is that the leakage flow conditioner aligns overtip leakage flow to match main flow. As such, work is extracted and the leakage flow is conditioned so that it results in reduced aerodynamic loss upon re-introduction into the main gas path.

Yet another advantage of the leakage flow conditioner is that the leakage flow conditioner results in reduced weight of the outer shroud, which results in reduced airfoil stress and reduced airfoil section required to carry the shroud load, which results in reduced aerodynamic profile loss, thereby increasing aerodynamic efficiency of the airfoil. The reduce airfoil stress also increases blade creep resistance.

Another advantage of the reduced mass of the shroud body is that the knife edge seal experiences enhanced contact.

Still another advantage of the leakage flow conditioner is that the leakage flow conditioner may include one or more stiffening rails to mitigate any increase shroud curl risk due to the leakage flow conditioner.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
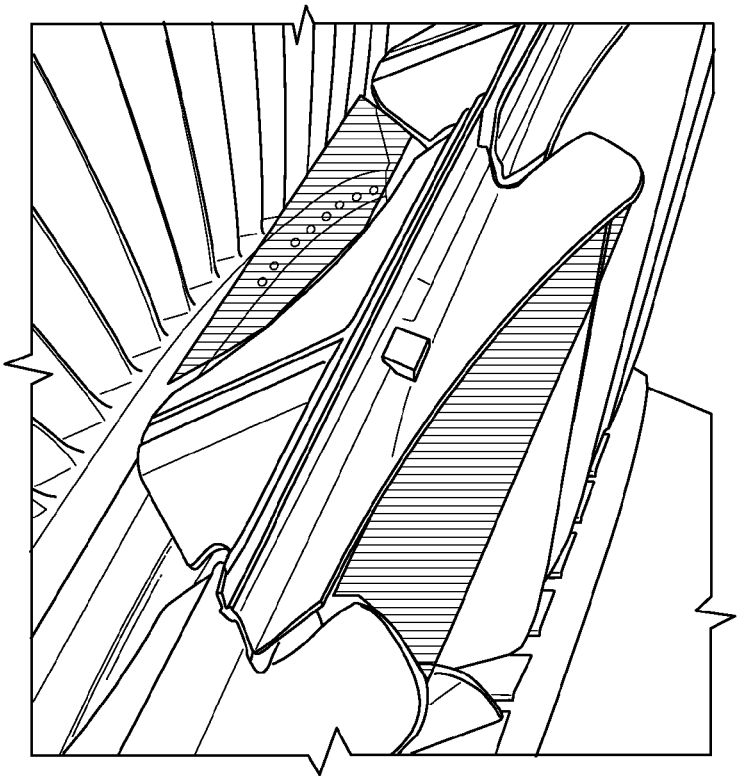
FIG. 1 PRIOR ART
FIG. 1 is a perspective view of a conventional turbine airfoil with an outer shroud.
Figure 2:
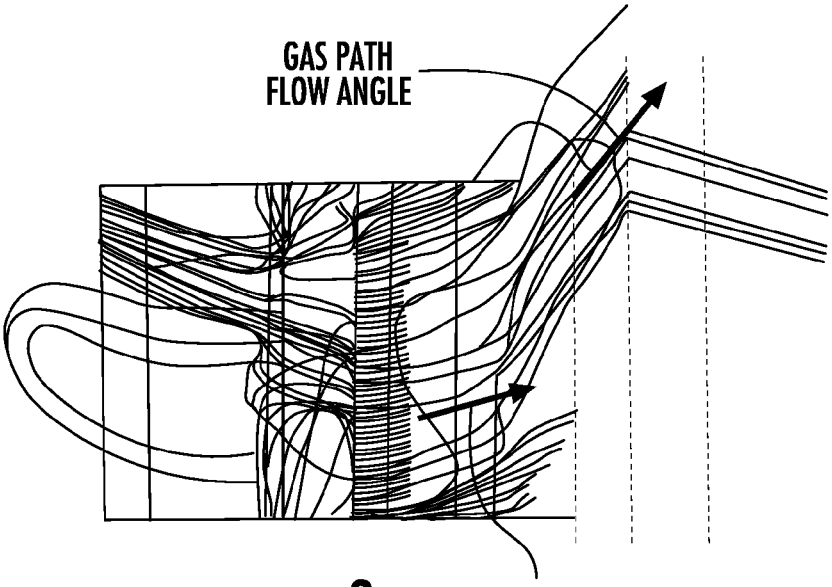
FIG. 2 PRIOR ART
FIG. 2 is a is a perspective view of the conventional turbine airfoil shown together with leakage flow and main gas flow.

As shown in FIGS. 3-11, a shrouded turbine airfoil 10 with a leakage flow conditioner 12 configured to direct leakage flow 14 to be aligned with main hot gas flow 16 is disclosed. The leakage flow conditioner 12 may be positioned on a radially outer surface 18 of an outer shroud base 20 of the outer shroud 22 on a tip 24 of an airfoil 10. The leakage flow conditioner 12 may include a radially outer surface 28 that is positioned further radially inward than the radially outer surface 18 of the outer shroud base 20 creating a radially outward extending wall surface 30 that serves to redirect leakage flow 14. In at least one embodiment, the radially outward extending wall surface 30 may be aligned with a pressure side 32 of the shrouded turbine airfoil 10 to increase the efficiency of a turbine engine 64 by redirecting leakage flow to be aligned with main hot gas flow 16 to reduce aerodynamic loss upon re-introduction to the main gas flow 16.

Figure 3:
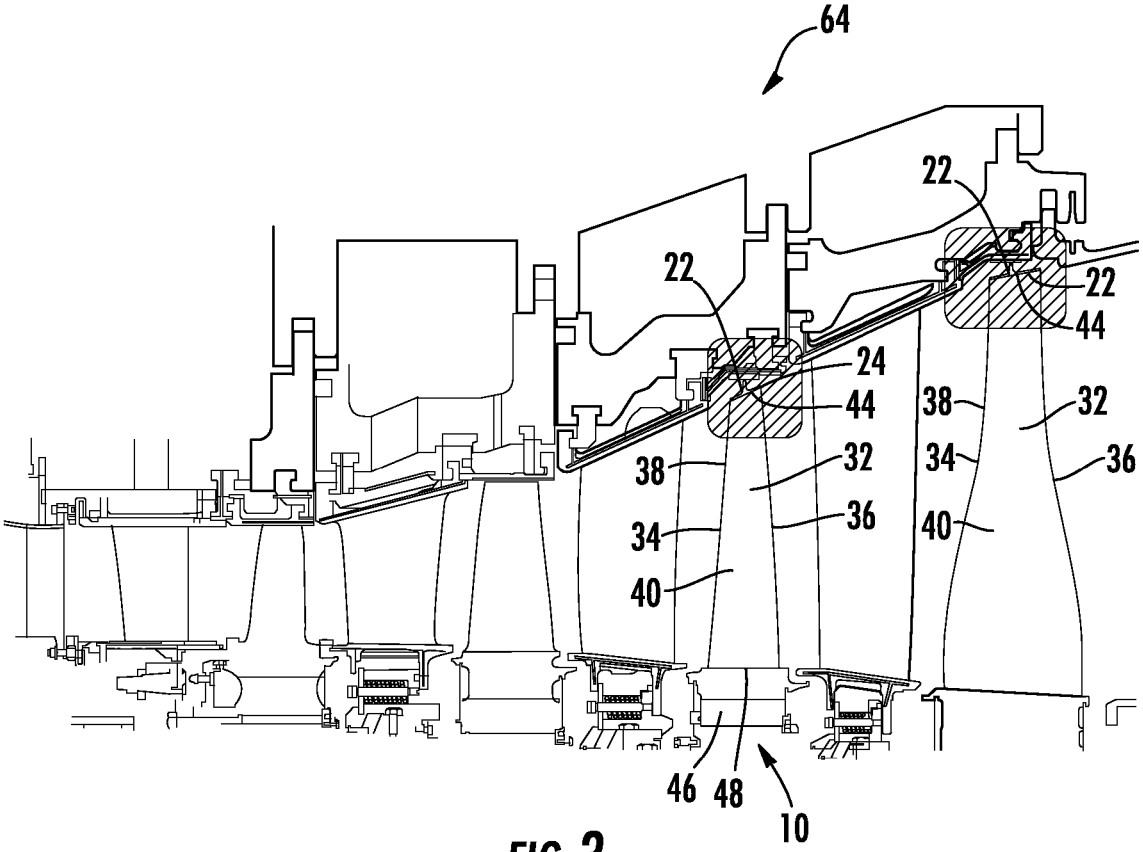
FIG. 3 is a perspective view of a gas turbine engine with shrouded turbine airfoils with at least one leakage flow conditioner.
Figure 4:
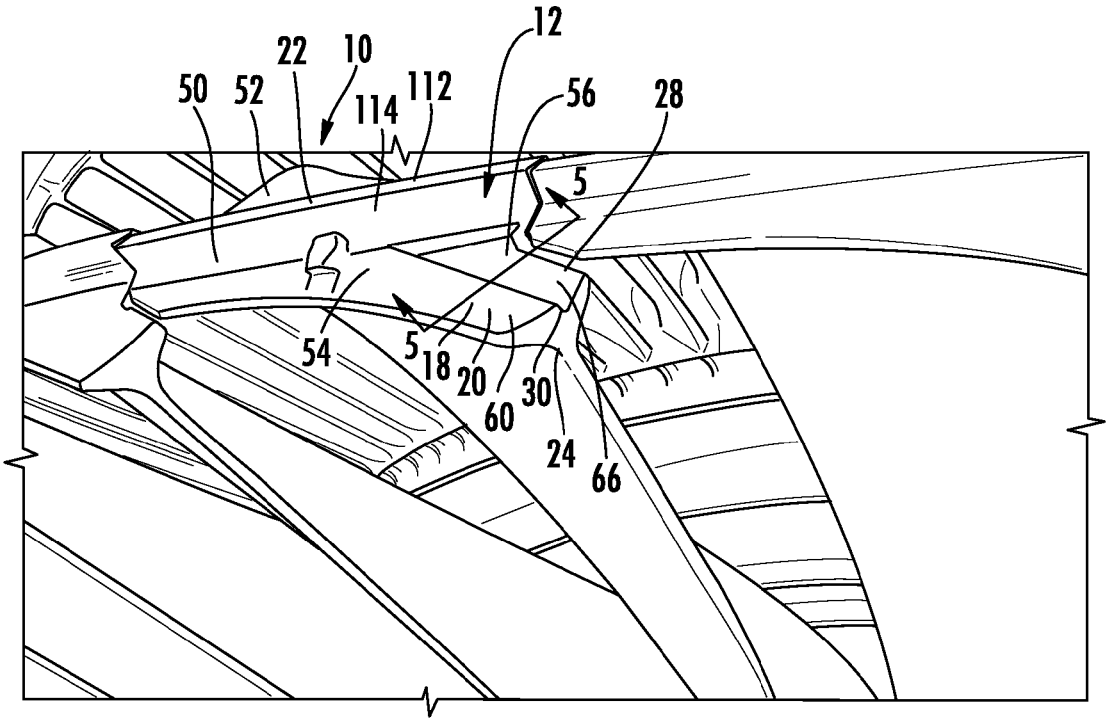
FIG. 4 is a perspective, generally upstream and radially inward view of a shrouded turbine airfoil usable within the gas turbine engine of FIG. 3 and including a downstream leakage flow conditioner.

In at least one embodiment, as shown in FIG. 3, the turbine airfoil 10 may be formed from a generally elongated airfoil 32 having a leading edge 34, a trailing edge 36, a pressure side 38, a suction side 40 on a side opposite to the pressure side 38, a tip 24 at a first end 44, a root 46 coupled to the airfoil 10 at a second end 48 generally opposite the first end 44 for supporting the airfoil 10 and for coupling the airfoil 10 to a disc. The turbine airfoil 10 may include one or more outer shrouds 22 coupled to the tip 24 of the generally elongated airfoil 32. The outer shroud 22 may extend in a direction generally from the pressure side 38 toward the suction side 40 and may extend circumferentially in a turbine engine 64. The outer shroud 22 may be formed at least in part by an outer shroud base 20 coupled to the tip 24 of the generally elongated airfoil 32 and an outer shroud body 50 extending radially outward from the outer shroud base 20. The outer shroud base 20 may have an upstream section 52 extending upstream of the outer shroud body 50 and a downstream section 54 extending downstream of the outer shroud body 50.

As shown in FIGS. 4-7 and 11, the turbine airfoil 10 may include a downstream leakage flow conditioner 58 positioned in the downstream section 54 extending downstream of the outer shroud body 50. A radially outer surface 56 of the downstream leakage flow conditioner 58 may be positioned further radially inward than a radially outer surface 60 of the downstream section 54 of the outer shroud base 20. In at least one embodiment, the downstream leakage flow conditioner 58 may be positioned in the outer shroud 22 on a pressure side 38 of the airfoil 32. An intersection 68 between the radially outer surface 56 of the downstream leakage flow conditioner 58 and the radially outer surface 60 of the downstream section 54 of the outer shroud base 20 may be nonparallel and nonorthogonal with a longitudinal axis 62 of a turbine engine 64 in which the generally elongated airfoil 32 is configured to be positioned. The downstream leakage flow conditioner 58 may extend from the outer shroud body 50 to a downstream edge 66 of the outer shroud base 20. The intersection 68 between the radially outer surface 56 of the downstream leakage flow conditioner 58 and the radially outer surface 60 of the downstream section 54 of the outer shroud base 20 may be generally aligned with the radially outward extending wall surface 30 of the side 42 of the generally elongated airfoil 32 at an intersection 70 of the generally elongated airfoil 32 and the outer shroud 22. More specifically, the downstream leakage flow conditioner 58 may be aligned with the blade trailing edge flow angle 120. The intersection 68 between the radially outer surface 56 of the downstream leakage flow conditioner 58 and the radially outer surface 60 of the downstream section 54 of the outer shroud base 20 may be formed from a radially outward extending wall surface 30. In at least one embodiment, the radially outward extending wall surface 30 may include a filleted surface 72 at an intersection with the radially outer surface 60 of the downstream section 54 of the outer shroud base 20 and includes a filleted surface 74 at an intersection with the radially outer surface 56 of the downstream leakage flow conditioner 58.

Figure 5:
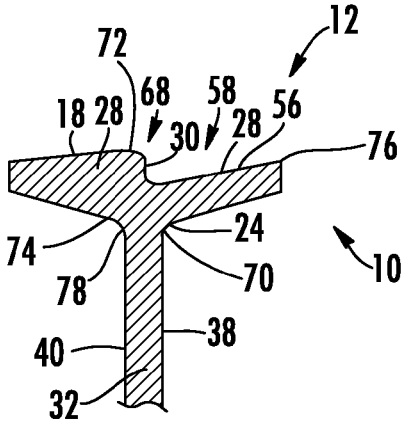
FIG. 5 is a cross-sectional view of the shrouded turbine airfoil of FIG. 4 taken at section line 5-5 in FIG. 4.
Figure 7:
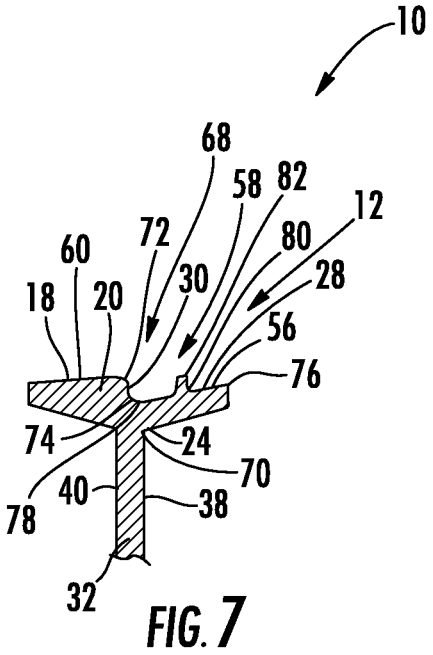
FIG. 7 is a cross-sectional view of the shrouded turbine airfoil of FIG. 6 taken at section line 7-7 in FIG. 6.

In at least one embodiment, as shown in FIGS. 5 and 7, the radially outer surface 56 of the downstream leakage flow conditioner 58 may be ramped such that a distal edge 76 is positioned radially further outward than a proximal edge 78 at the radially outward extending wall surface 30 between the downstream leakage flow conditioner 58 and the radially outer surface 60 of the downstream section 54 of the outer shroud base 20. The radially outer surface 60 of the downstream leakage flow conditioner 58 may be positioned at any appropriate angle.

Figure 6:
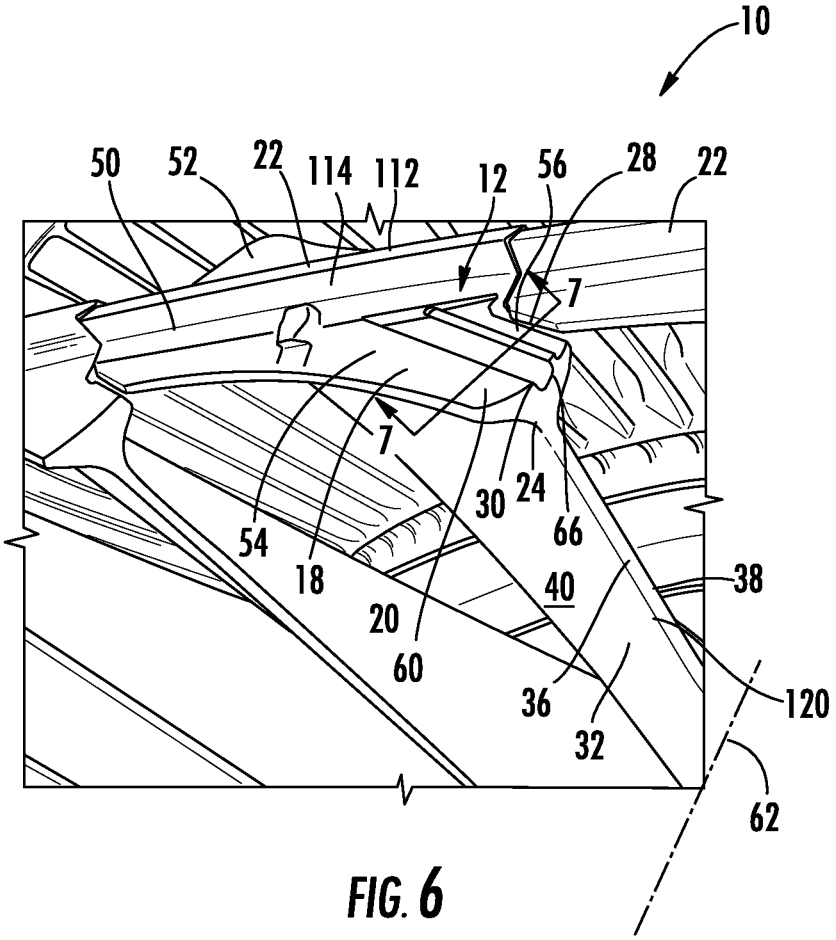
FIG. 6 is a perspective, generally upstream and radially inward view of another embodiment of a shrouded turbine airfoil usable within the gas turbine engine of FIG. 3 and including a downstream leakage flow conditioner.
Figure 11:
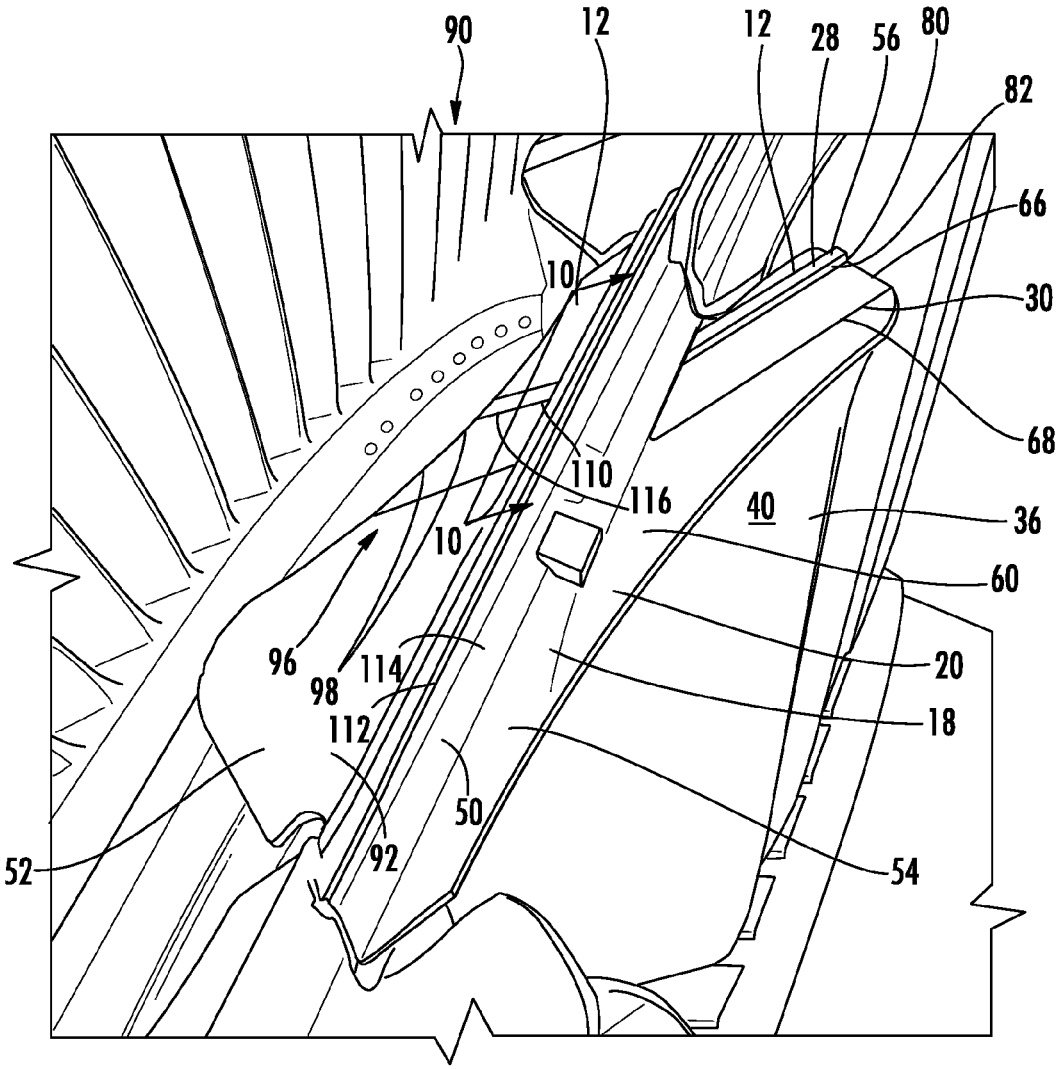
FIG. 11 is a perspective, generally upstream and radially inward view of another embodiment of a shrouded turbine airfoil usable within the gas turbine engine of FIG. 3 and including a downstream leakage flow conditioner and an upstream leakage flow conditioner.

As shown in FIGS. 6, 7 and 11, the turbine airfoil 10 may include one or more stiffening rails 80 extending radially outward from the radially outer surface 56 of the downstream leakage flow conditioner 58. The stiffening rail 80 may mitigate any increase shroud curl risk due to the downstream leakage flow conditioner 58. A radially outer distal end 82 of the at least one stiffening rail 80 is positioned radially inward further than the radially outer surface 60 of the downstream section 54 of the outer shroud base 20. In at least one embodiment, the radially outer distal end 82 of the stiffening rail 80 is a linear surface. The stiffening rail 80 may extend from the outer shroud body 50 to a downstream edge 66 of the outer shroud base 20 or may have a shorter length.

Figure 9:
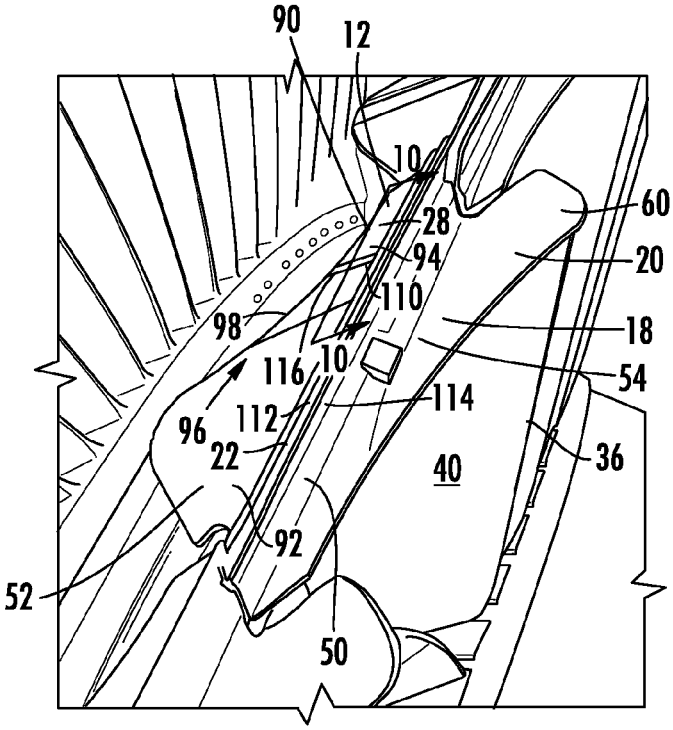
FIG. 9 is a perspective, generally upstream and radially inward view of another embodiment of a shrouded turbine airfoil usable within the gas turbine engine of FIG. 3 and including an upstream leakage flow conditioner.
Figure 10:
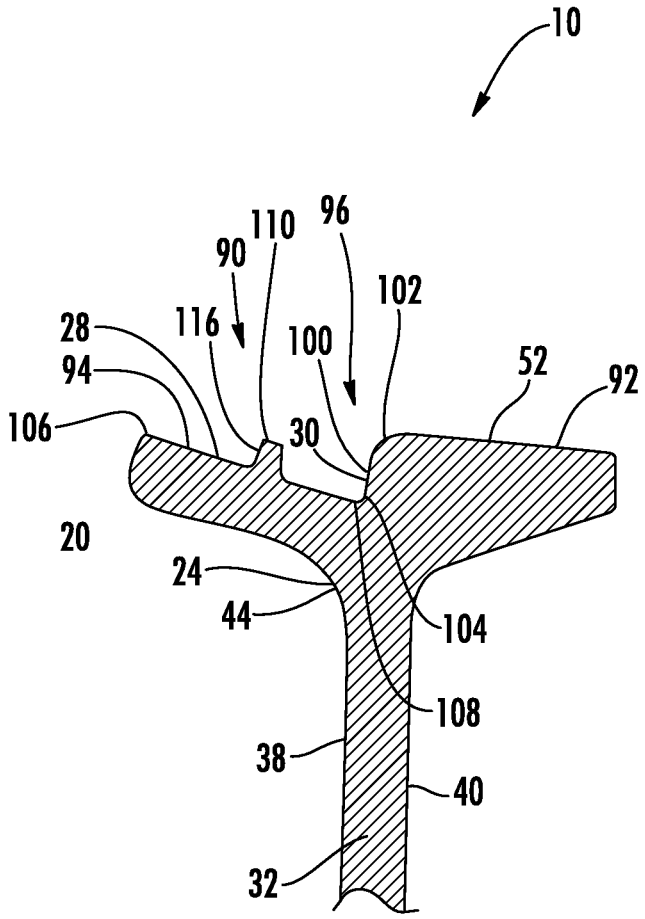
FIG. 10 is a cross-sectional view of the shrouded turbine airfoil of FIG. 9 taken at section line 10-10 in FIGS. 9 and 11.

As shown in FIGS. 9-11, the turbine airfoil 10 may also include an upstream leakage flow conditioner 90. The upstream leakage flow conditioner 90 may be included on the airfoil 10 together with the downstream leakage flow conditioner 58 or in place of the downstream leakage flow conditioner 58. The upstream leakage flow conditioner 90 may be configured similarly to the downstream leakage flow conditioner 58 or have another configuration. for example, the turbine airfoil 10 may include an upstream leakage flow conditioner 90 positioned in the upstream section 52 extending upstream of the outer shroud body 50. A radially outer surface 94 of the upstream leakage flow conditioner 90 may be positioned further radially inward than a radially outer surface 92 of the upstream section 52 of the outer shroud base 20. In at least one embodiment, the upstream leakage flow conditioner 90 may be positioned in the outer shroud 22 on a pressure side 38 of the airfoil 32. An intersection 96 between the radially outer surface 94 of the upstream leakage flow conditioner 90 and the radially outer surface 92 of the upstream section 52 of the outer shroud base 20 may be nonparallel and nonorthogonal with the longitudinal axis 62 of the turbine engine 64 in which the generally elongated airfoil 32 is configured to be positioned. The upstream leakage flow conditioner 90 may extend from the outer shroud body 50 to an upstream edge 98 of the outer shroud base 20.

The intersection 96 between the radially outer surface 94 of the upstream leakage flow conditioner 90 and the radially outer surface 92 of the upstream section 52 of the outer shroud base 20 may be generally aligned with pressure side 42 of the generally elongated airfoil 32 at an intersection 70 of the generally elongated airfoil 32 and the outer shroud 20. More specifically, the radially outward extending wall surface 100 of the upstream leakage flow conditioner 90 may be aligned with the blade trailing edge flow angle 120. The intersection 96 between the radially outer surface 94 of the upstream leakage flow conditioner 90 and the radially outer surface 92 of the upstream section 52 of the outer shroud base 20 may be formed from a radially outward extending wall surface 100. In at least one embodiment, the radially outward extending wall surface 100 may include a filleted surface 102 at an intersection with the radially outer surface 92 of the upstream section 52 of the outer shroud base 20 and may include a filleted surface 104 at an intersection with the radially outer surface 94 of the upstream leakage flow conditioner 90.

In at least one embodiment, as shown in FIG. 10, the radially outer surface 94 of the upstream leakage flow conditioner 90 may be ramped such that a distal edge 106 is positioned radially further outward than a proximal edge 108 at a radially outward extending wall surface 100 between the upstream leakage flow conditioner 90 and the radially outer surface 92 of the upstream section 52 of the outer shroud base 20. The radially outer surface 94 of the upstream leakage flow conditioner 90 may be positioned at any appropriate angle.

The turbine airfoil 10 may include an one or more stiffening rails 116 extending radially outward from the radially outer surface 92 of the upstream leakage flow conditioner 52. The stiffening rail 116 may mitigate any increase shroud curl risk due to the upstream leakage flow conditioner 52. A radially outer distal end 110 of the stiffening rail 116 may be positioned radially inward further than the radially outer surface 92 of the upstream section 52 of the outer shroud base 20. In at least one embodiment, the radially outer distal end 110 of the stiffening rail 116 may be a linear surface. The stiffening rail 116 may extend from the outer shroud body 50 to an upstream edge 98 of the outer shroud base 20 or may have a shorter length.

The outer shroud 22 may include a knife edge seal 112 extending radially outward from a radially outer end 114 of the outer shroud body 50. In at least one embodiment, the knife edge seal 112 may be generally circumferentially symmetric, thereby forming an efficient seal when installed in a turbine engine.

Figure 8:
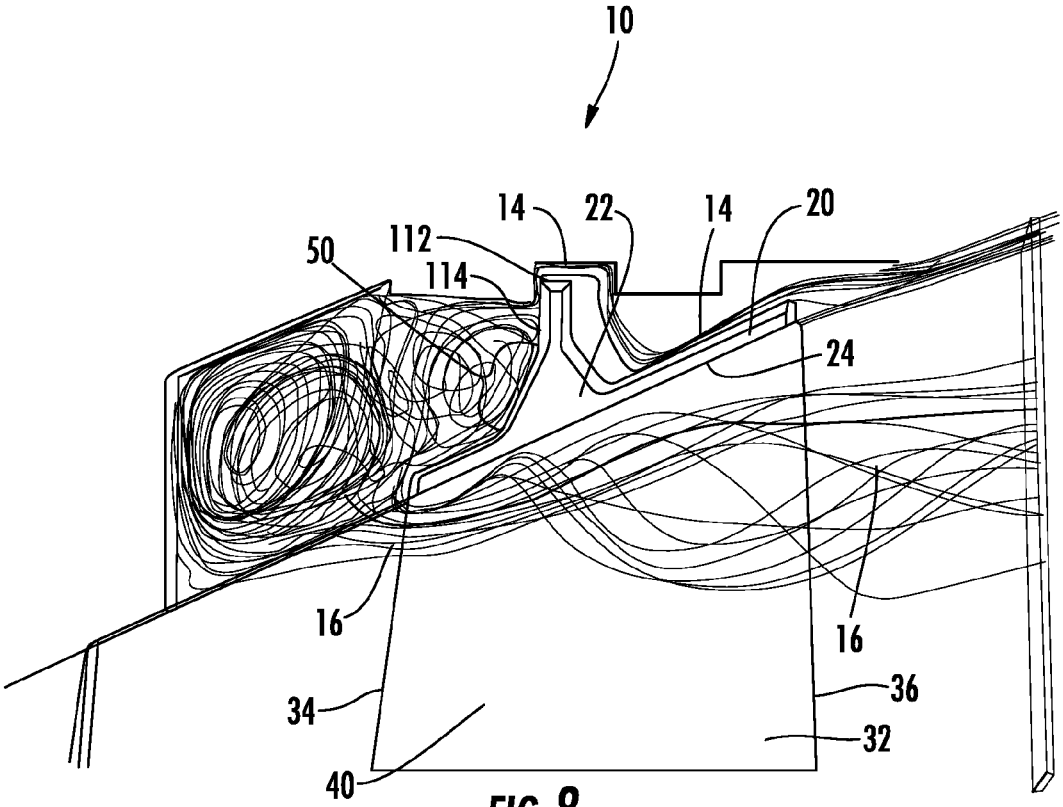
FIG. 8 is a schematic diagram of the flows of hot combustion gases around a shrouded airfoil with at least one leakage flow conditioner.

During use, as shown in FIG. 8, hot gas in the main flow 16 may pass through the outer shroud 22 to form leakage flow 14. The leakage flow 14 strikes the downstream leakage flow conditioner 58 and is redirected to flow in a direction of the main hot gas flow 16 downstream of the shrouded turbine airfoil 10. In at least one embodiment, the leakage flow 14 strikes the radially outward extending wall surface 30 of the downstream leakage flow conditioner 58 and is redirected. In the circumferential direction, the radially outer surface 56 of the downstream leakage flow conditioner 58 may be positioned as a ramp, which increases flow area locally at the outer shroud 22, hence, flow velocity decreases and pressure increases resulting in a resultant pressure surface on the outer shroud 22 to encourage work extraction.

In another embodiment, portions of the main flow 16 radially outward of the airfoil tip 24 and upstream of the outer shroud body 50 may strike the upstream leakage flow conditioner 90 and be redirected to flow in a direction of the main hot gas flow 16 before the portion of the main flow becomes leakage flow 14 downstream of the outer shroud body 50. In the circumferential direction, the radially outer surface 92 of the upstream leakage flow conditioner 90 may be positioned as a ramp, which increases flow area locally at the outer shroud 22, hence, flow velocity decreases and pressure increases resulting in a resultant pressure surface on the outer shroud 22 to encourage work extraction.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil comprising:

a generally elongated airfoil having a leading edge, a trailing edge, a pressure side, a suction side on a side opposite to the pressure side, a tip at a first end, a root coupled to the airfoil at a second end generally opposite the first end for supporting the airfoil and for coupling the airfoil to a disc;

at least one outer shroud coupled to the tip of the generally elongated airfoil;

wherein the at least one outer shroud extends in a direction generally from the pressure side toward the suction side and extends circumferentially in a turbine engine;

wherein the at least one outer shroud is formed at least in part by an outer shroud base coupled to the tip of the generally elongated airfoil and an outer shroud body extending radially outward from the outer shroud base;

wherein the outer shroud base has an upstream section extending upstream of the outer shroud body and a downstream section extending downstream of the outer shroud body;

a downstream leakage flow conditioner positioned in the downstream section extending downstream of the outer shroud body;

wherein a radially outer surface of the downstream leakage flow conditioner is positioned further radially inward than a radially outer surface of the downstream section of the outer shroud base;

wherein an intersection between the radially outer surface of the downstream leakage flow conditioner and the radially outer surface of the downstream section of the outer shroud base is nonparallel and nonorthogonal with a longitudinal axis of a turbine engine in which the generally elongated airfoil is configured to be positioned, wherein the intersection between the radially outer surface of the downstream leakage flow conditioner and the radially outer surface of the downstream section of the outer shroud base is formed from a radially outward extending wall surface, and wherein the radially outer surface of the downstream leakage flow conditioner is ramped such that a distal edge is positioned radially further outward than a proximal edge at a radially outward extending wall surface between the downstream leakage flow conditioner and the radially outer surface of the downstream section of the outer shroud base.

2. The turbine airfoil of claim 1, wherein the downstream leakage flow conditioner extends from the outer shroud body to a downstream edge of the outer shroud base.

3. The turbine airfoil of claim 1, wherein the intersection between the radially outer surface of the downstream leakage flow conditioner and the radially outer surface of the downstream section of the outer shroud base is generally aligned with the pressure side of the generally elongated airfoil at an intersection of the generally elongated airfoil and the at least one outer shroud.

4. The turbine airfoil of claim 1, wherein the radially outward extending wall surface includes a filleted surface at an intersection with the radially outer surface of the downstream section of the outer shroud base and includes a filleted surface at an intersection with the radially outer surface of the downstream leakage flow conditioner.

5. The turbine airfoil of claim 1, further comprising at least one stiffening rail extending radially outward from the radially outer surface of the downstream leakage flow conditioner.

6. The turbine airfoil of claim 5, wherein a radially outer distal end of the at least one stiffening rail is positioned radially inward further than the radially outer surface of the downstream section of the outer shroud base.

7. The turbine airfoil of claim 6, wherein the radially outer distal end of the at least one stiffening rail is a linear surface.

8. The turbine airfoil of claim 6, wherein the at least one stiffening rail extends from the outer shroud body to a downstream edge of the outer shroud base.

9. The turbine airfoil of claim 1, further comprising an upstream leakage flow conditioner positioned in the upstream section extending upstream of the outer shroud body;

wherein a radially outer surface of the upstream leakage flow conditioner is positioned further radially inward than the radially outer surface of the upstream section of the outer shroud base; and wherein an intersection between the radially outer surface of the upstream leakage flow conditioner and a radially outer surface of the upstream section of the outer shroud base is nonparallel and nonorthogonal with a longitudinal axis of a turbine engine in which the generally elongated airfoil is configured to be positioned.

10. The turbine airfoil of claim 9, wherein the upstream leakage flow conditioner extends from the outer shroud body to an upstream edge of the outer shroud base.

11. The turbine airfoil of claim 9, wherein the intersection between the radially outer surface of the upstream leakage flow conditioner and the radially outer surface of the upstream section of the outer shroud base is generally aligned with pressure side of the generally elongated airfoil at an intersection of the generally elongated airfoil and the at least one outer shroud.

12. The turbine airfoil of claim 9, wherein the intersection between the radially outer surface of the upstream leakage flow conditioner and the radially outer surface of the upstream section of the outer shroud base is formed from a radially outward extending wall surface.

13. The turbine airfoil of claim 12, wherein the radially outward extending wall surface includes a filleted surface at an intersection with the radially outer surface of the upstream section of the outer shroud base and includes a filleted surface at an intersection with the radially outer surface of the upstream leakage flow conditioner.

14. The turbine airfoil of claim 9, wherein the radially outer surface of the upstream leakage flow conditioner is ramped such that a distal edge is positioned radially further outward than a proximal edge at a radially outward extending wall surface between the upstream leakage flow conditioner and the radially outer surface of the upstream section of the outer shroud base.

15. The turbine airfoil of claim 9, further comprising at least one stiffening rail extending radially outward from the radially outer surface of the upstream leakage flow conditioner.

16. The turbine airfoil of claim 15, wherein a radially outer distal end of the at least one stiffening rail is positioned radially inward further than the radially outer surface of the upstream section of the outer shroud base.

17. The turbine airfoil of claim 16, wherein the radially outer distal end of the at least one stiffening rail is a linear surface.

18. The turbine airfoil of claim 16, wherein the at least one stiffening rail extends from the outer shroud body to an upstream edge of the outer shroud base.

* * * * *